US011219893B2

(12) United States Patent
Binder

(10) Patent No.: US 11,219,893 B2
(45) Date of Patent: Jan. 11, 2022

(54) HOUSING FOR A SIMULATION CHAMBER

(71) Applicant: Binder GmbH, Tuttlingen (DE)

(72) Inventor: Peter M. Binder, Tuttlingen (DE)

(73) Assignee: Binder GmbH, Tuttlingen (DE)

( * ) Notice: Subject to any disclaimer, the term of this patent is extended or adjusted under 35 U.S.C. 154(b) by 465 days.

(21) Appl. No.: 16/396,034

(22) Filed: Apr. 26, 2019

(65) Prior Publication Data

US 2019/0374935 A1 Dec. 12, 2019

(30) Foreign Application Priority Data

Jun. 8, 2018 (DE) ..... 20 2018 103 236.4

(51) Int. Cl.
*B01L 1/00* (2006.01)
*B01L 1/02* (2006.01)

(52) U.S. Cl.
CPC ..... *B01L 1/025* (2013.01); *B01L 2300/10* (2013.01); *B01L 2300/14* (2013.01); *B01L 2300/18* (2013.01)

(58) Field of Classification Search
CPC ..... B01L 1/025; F25D 29/005
See application file for complete search history.

(56) References Cited

U.S. PATENT DOCUMENTS

| | | | |
|---|---|---|---|
| 5,921,095 | A | 7/1999 | Lee et al. |
| 2006/0108903 | A1 | 5/2006 | Bauer et al. |
| 2016/0242242 | A1 | 8/2016 | Carlsson et al. |

FOREIGN PATENT DOCUMENTS

| | | |
|---|---|---|
| CN | 202024532 | 11/2011 |
| CN | 103443567 | 12/2013 |
| CN | 204157999 | 2/2015 |
| CN | 206166287 | 5/2017 |
| CN | 207407401 | 5/2018 |
| CN | 207422287 | 5/2018 |
| DE | 10259749 | 7/2004 |
| WO | 2010015553 | 2/2010 |

OTHER PUBLICATIONS

European Patent Office, "Extended European Search Report," issued in European Patent Application No. 19 151 094.0, dated Jun. 28, 2019, document of 5 pages.
The State Intellectual Property Office of People's Republic of China, "First Office Action," and English translation thereof, issued in Chinese Patent Application No. 201910189548.8, dated Mar. 25, 2021, document of 15 pages.
The State Intellectual Property Office of People's Republic of China, "Second Office Action," and English translation thereof, issued in Chinese Patent Application No. 201910189548.8, dated Mar. 25, 2021, document of 15 pages.

*Primary Examiner* — Christopher Adam Hixson
(74) *Attorney, Agent, or Firm* — Akerman LLP; Peter A. Chiabotti

(57) ABSTRACT

A housing for a simulation chamber having a chamber body, a door arranged on the chamber body, and a controller housing, wherein the controller housing is arranged on the chamber body and comprises an outer surface, an inner surface, and at least one side surface, in that the door comprises an outer surface, an inner surface, and at least five side surfaces, wherein the controller housing is arranged on the chamber body in such a manner that, when the door is closed, at least one of the side surfaces of the door is arranged facing at least one of the side surfaces of the controller housing.

14 Claims, 2 Drawing Sheets

HOUSING FOR A SIMULATION CHAMBER

CROSS-REFERENCE TO RELATED APPLICATIONS

This application claims priority to German Patent Application No. 20 2018 103 236.4, filed Jun. 8, 2018, which is incorporated by reference in its entirety.

BACKGROUND

The present application relates to a housing for a simulation chamber having the structures and features described herein.

SUMMARY

Housings for simulation chambers are known which comprise a chamber body, a door arranged on said chamber body, and a controller housing.

Simulation chambers can be used at scientific laboratories or in industrial applications for generating and simulating biological, chemical, and/or physical room conditions or environmental influences, such as temperature, air pressure, and/or humidity. The controller housing therefore typically comprises means for adjusting such parameters. Housings for simulation chambers in which the controller housing is arranged on the outer surface of the door are known from prior art. In such an arrangement, electrical cables for transmitting the set parameters must be conducted from the controller housing through the door into the chamber body.

The present disclosure provides a housing for a simulation chamber which is easier to manufacture.

The housing according to the present disclosure is for a simulation chamber having a chamber body, a door arranged on the chamber body, and a controller housing is characterized in that the controller housing is arranged on the chamber body and comprises an outer surface, an inner surface, and at least one side surface, in that the door comprises an outer surface, an inner surface, and at least five side surfaces, wherein the controller housing is arranged on the chamber body in such a manner that at least one of the side surfaces of the door is arranged facing at least one of the side surfaces of the controller housing.

A side surface, as used here, is an area which extends substantially perpendicular to the outer surface and particularly connects the outer surface to the inner surface. Side surfaces facing each other particularly are side surfaces which extend parallel to each other, wherein at least one straight line exists which intersects orthogonally with both side surfaces.

As a result of the arrangement of the controller housing on the chamber body, electrical cables can be conducted directly from the controller housing into the chamber body, and conducting them through the door, particularly from the door that can be moved relative to the chamber body into the chamber body, can be avoided. In addition, a controller housing that projects from the door can be avoided, which housing poses the risk of getting caught on it or the risk of injury.

Advantageously, the chamber body comprises a bottom wall, a top wall, two side walls, a rear wall, and a front side with an opening that can be closed by the door, wherein the controller housing is arranged on the front side. This results in a particularly space-saving design.

According to a preferred embodiment of the present disclosure, the door has a thickness and the controller housing has a depth, wherein the thickness of the door about matches the depth of the controller housing. This design avoids projecting elements.

The outer surfaces of the door and the outer surface of the controller housing when the door is closed are preferably in one plane, which allows to avoid projections.

In an advantageous embodiment of the present disclosure, one of the side surfaces defines a recess which is located completely inside the door, wherein the controller housing is arranged inside said recess when the door is closed. In other words, the door comprises a hole in this case into which the controller enters when the door is closed, wherein the controller housing continues to be accessible from the outside when the door is closed.

According to a particularly preferred further embodiment of the present disclosure, the door has four side surfaces, of which two respective adjacent side surfaces are arranged orthogonally to each other, wherein the fifth side surface is arranged at an obtuse angle to two side surfaces arranged orthogonally to each other. In other words, the outer surface of the door is pentagonal, particularly in such a manner that one of the corners of an imaginary rectangle was cut off by a section, particularly in the form of the fifth side surface. Such a fifth side surface results in a region on the front side of the chamber body, which remains free even if the door is closed and in which the controller housing can be arranged. This results in a particularly space-saving design.

The outer surface of the controller housing and the outer surface of the door preferably complement each other to form a rectangular area when the door is closed, which allows a particularly favorable utilization of space.

According to a particularly preferred embodiment of the present disclosure, the outer surface of the controller housing is triangular and the outer surface of the door is pentagonal in design. Such an arrangement allows a favorable utilization of the existing space and at the same time easy manufacturing.

Advantageously, the controller housing has a shape which complements the shape of the door when the door is closed to form an approximate cuboid. This allows a favorable utilization of the existing space and at the same time avoids any projecting edges.

The controller housing preferably has at least one side surface which is in the same plane as one of the side surfaces of the door when the door is closed. This can help avoid disadvantageous steps or projections.

Steps or projections can particularly be avoided if the controller housing has at least one side surface which is adjoined in a flush manner with one of the side surfaces of the door.

BRIEF DESCRIPTION OF DRAWINGS

An exemplary embodiment of the present application will be explained in detail below with reference to the figures. Wherein.

DETAILED DESCRIPTION

Figure 1:
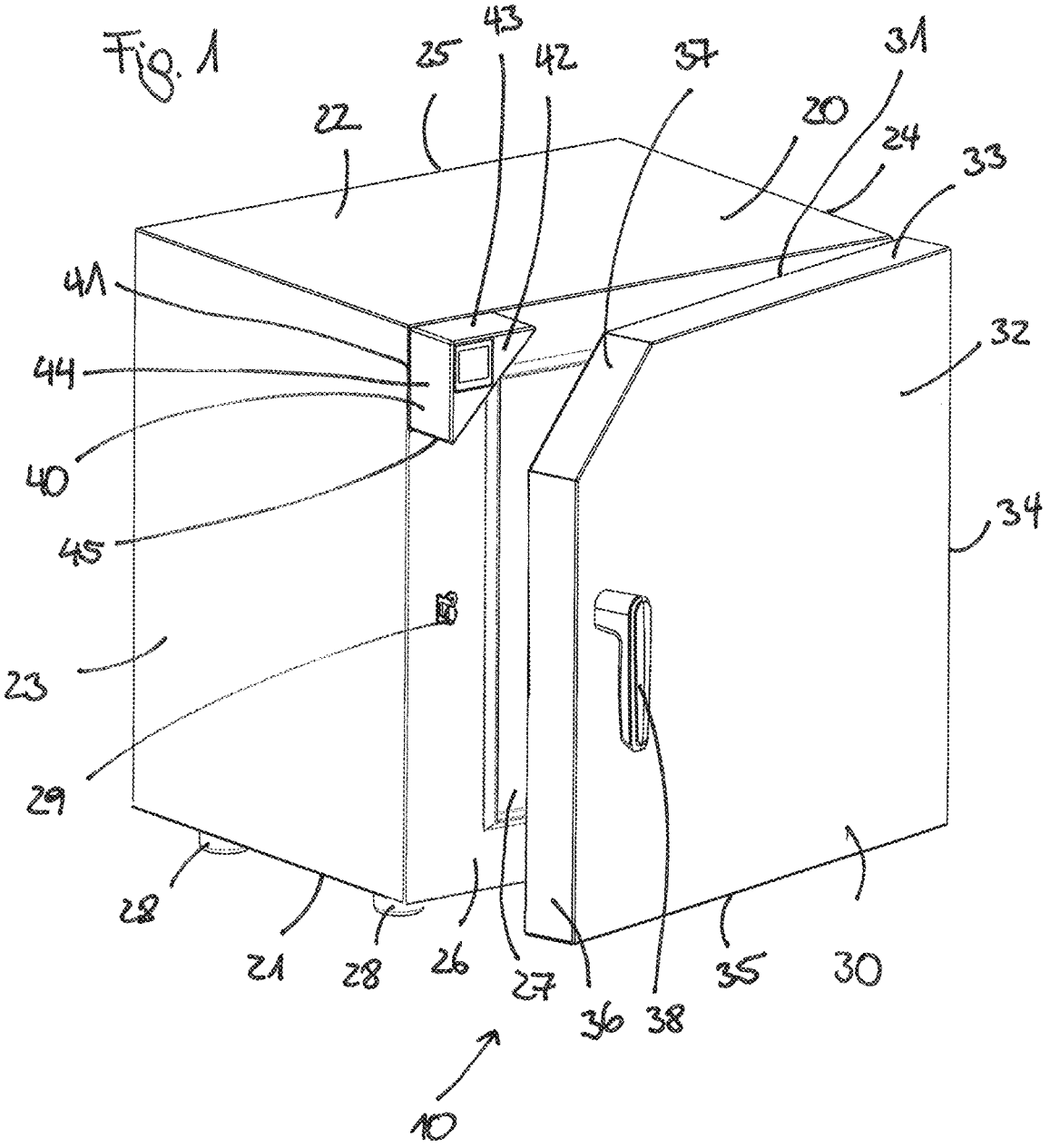
FIG. 1 is a perspective view of a first exemplary embodiment of a housing for a simulation chamber comprising a chamber body, a door arranged on the chamber body, and a controller housing, wherein the door is slightly open.
Figure 2:
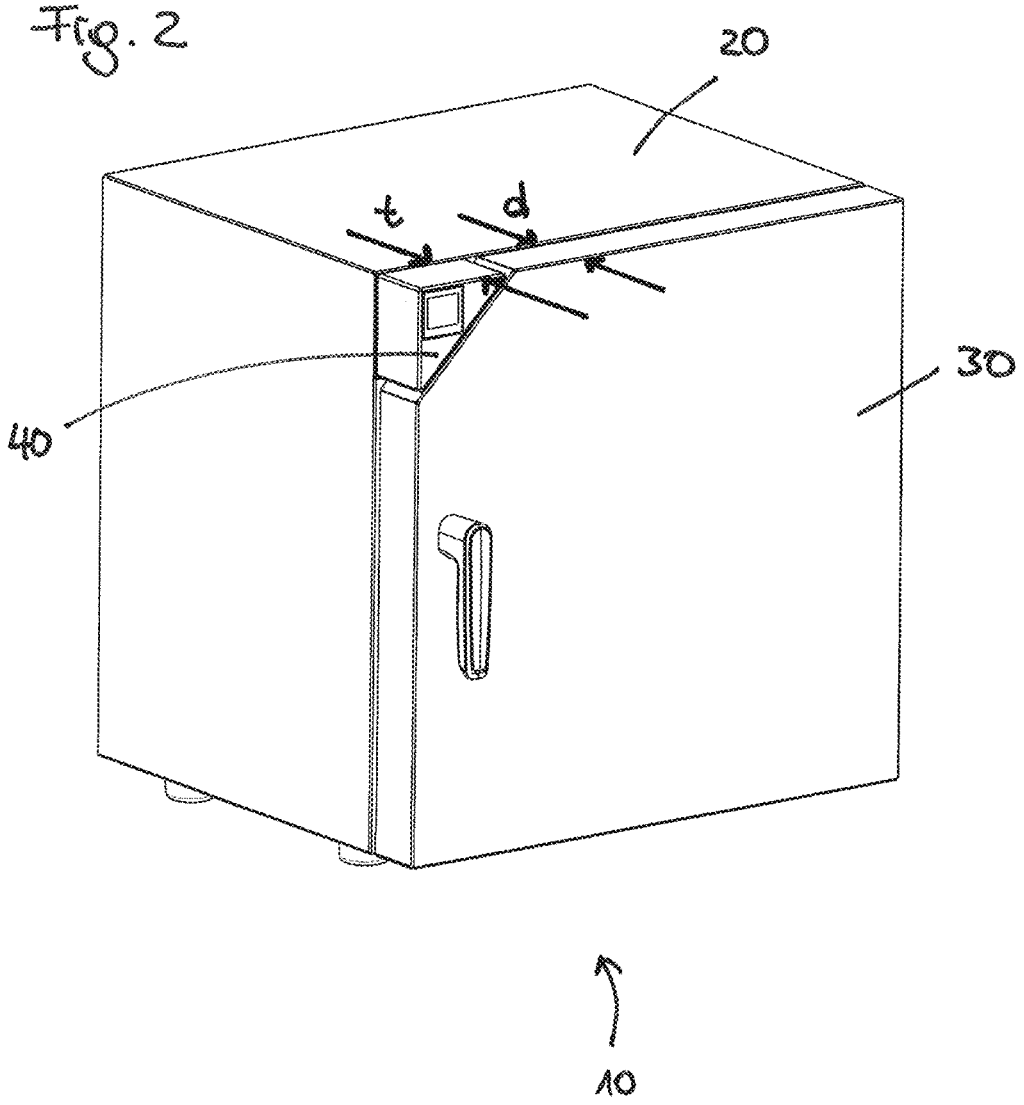
FIG. 2 shows the housing of FIG. 1, wherein the door is closed.

FIGS. 1 and 2 show different views of a housing 10 for a simulation chamber comprising a chamber body 20, a door 30 arranged on said chamber body 20, and a controller housing 40. The chamber body 20 can comprise a bottom wall 21, a top side 22, which is particularly extending parallel to the bottom wall 21, two side walls 23, 24, which are particularly arranged parallel to each other and orthogonally to the bottom wall 21, a rear wall 25, which is particularly arranged orthogonally to the bottom wall 21 and orthogonally to the two side walls 23, 24, and a front side 26, which is particularly arranged parallel to the bottom wall 21. The front side 26 has an opening 27 through which the interior of the chamber body 20 is accessible and which can be closed by the door 30.

The chamber body 20 may comprise one or several feet 28, for example four feet 28.

The door 30 is pivotably arranged on the chamber body 20, for example by means of hinges not shown in the figures. The door 30 has an inner surface 31, an outer surface 32, which is particularly arranged parallel to the inner surface 31, and at least five, in the exemplary embodiment shown here exactly five, side surfaces 33, 34, 35, 36, 37. The side surfaces 33, 34, 35, 36, 37 are particularly arranged orthogonally to the inner surface 31 and the outer surface 32. The side surfaces 33, 34, 35, 36, 37 particularly connect the inner surface 31 with the outer surface 32. In this embodiment, the side surfaces 33 and 34, the side surfaces 34 and 35, the side surfaces 35 and 36, and the side surfaces 36 and 33 are aligned orthogonal to each other. The side surfaces 36 and 33 do not directly adjoin each other but are connected via the fifth side surface 37 which extends at an obtuse angle to the side surfaces 33 and 36. The side surfaces 33, 34, 35, 36, 37 are overall particularly arranged in such a manner that the outer surface 32 of the door 30 is pentagonal.

A handle 38 with which the door 30 can be opened and closed can be arranged on the door 30. For example, the handle 38 can be used to operate a closing mechanism 29 via which the door 30, in its closed position, can be fixed to the chamber body 20. The closing mechanism 29 can for example be designed as a bracket arranged on the chamber body 20 into which a latch arranged on the door 30, which latch is not visible in the figures, engages.

The controller housing 40 has an inner surface 41, an outer surface 42, which is particularly arranged parallel to the inner surface 41, and at least one, in the exemplary embodiment shown here exactly three, side surfaces 43, 44, 45. The side surfaces 43, 44, 45 are particularly arranged such that a triangular outer surface 42 is formed. Advantageously the two side surfaces 43, 44 are arranged orthogonally to each other. The controller housing 40 is arranged on the chamber body 20, particularly on its front side 26. Particularly the inner surface 41 is arranged on the chamber body 20. The controller housing 40 is positioned such that, when the door 30 is closed, at least one of the side surfaces of the door 30, particularly the side surface 37 is arranged facing at least one of the side surfaces of the controller housing 40, namely the side surface 45 of the controller housing 40. When the door 30 is closed, particularly the side surface 43 extends in the same plane as the side surface 33 of the door 30 and preferably transitions flush into the same. Advantageously, when the door 30 is closed, the side surface 44 of the controller housing 40 extends in the same plane as the side surface 36 of the door 30 and preferably transitions flush into the same. Advantageously, the outer surface 32 of the door 30 is in one plane with the outer surface 42 of the controller housing 40 when the door 30 is closed.

The door has a thickness d, which particularly corresponds to the distance of the inner surface 31 and the outer surface 32. The controller housing 40 has a depth t, which particularly corresponds to the distance of the inner surface 41 to the outer surface 42. Particularly, the depth t about matches the thickness d of the door 30.

When the door 30 is closed, particularly the outer surface 32 of the door 30 and the outer surface 42 of the controller housing 40, apart from slight design-related air gaps between the door 30 and the controller housing 40, complement each other to form a triangular area, and the shapes of the door 30 and of the controller housing 40 complement each other to form a cuboid. It is particularly advantageous when the front side 26 of the controller housing is arranged on one of the top corners, to allow easy access. The controller housing is particularly arranged on the top left corner if the right side surface 34 of the door 30 is pivotably arranged on the chamber body 20.

LIST OF REFERENCE SYMBOLS

10 Housing
20 Chamber body
21 Bottom wall
22 Top side
23 Side wall
24 Side wall
25 Rear wall
26 Front side
27 Opening
28 Foot
29 Closing mechanism
30 Door
31 Inner surface
32 Outer surface
33 Side surface
34 Side surface
35 Side surface
36 Side surface
37 Side surface
38 Handle
40 Controller housing
41 Inner surface
42 Outer surface
43 Side surface
44 Side surface
45 Side surface
d Thickness
t Depth

What is claimed:

1. A housing for a simulation chamber, comprising:
a chamber body;
a door arranged on the chamber body;
a controller housing arranged on the chamber body and comprising:
a controller housing outer surface;
a controller housing inner surface;
a controller housing side surface;
wherein the door comprises a door outer surface, a door inner surface, and at least five door side surfaces; and
wherein the controller housing is arranged on the chamber body such that when the door is closed, at least one of the door side surfaces is arranged facing the controller housing side surface.

2. The housing according to claim 1, wherein the chamber body comprises a chamber bottom wall, a chamber top side, two chamber side walls, a chamber rear wall, and a chamber front side having an opening which can be closed by the door, wherein the controller housing is arranged on the chamber front side.

3. The housing according to claim 1, wherein the door has a thickness and the controller housing has a depth, wherein the thickness of the door about matches the depth of the controller housing.

4. The housing according to claim 1, wherein the door outer surface and the controller housing outer surface are approximately in one plane when the door is closed.

5. The housing according to claim 1, wherein one of the door side surfaces defines a recess which penetrates the door and is located completely inside the door, wherein the controller housing is arranged inside said recess when the door is closed.

6. The housing according to claim 1, wherein the door comprises four door side surfaces, of which two adjacent ones are arranged orthogonally to each other, and wherein a fifth door side surface is arranged at an obtuse angle to two door side surfaces arranged orthogonally to each other.

7. The housing according to claim 1, wherein the controller housing outer surface and the door outer surface complement each other to form approximately a rectangular area when the door is closed.

8. The housing according to claim 1, wherein the outer surface of the controller housing is configured triangularly and the outer surface of the door is configured pentagonally.

9. The housing according to claim 1, wherein the controller housing has a shape which together with a shape of the door forms approximately a cuboid when the door is closed.

10. The housing according to claim 1, wherein the controller housing has at least one controller housing side surface which is approximately in the same plane as one of the door side surfaces when the door is closed.

11. The housing according to claim 1, wherein the controller housing has at least one controller housing side surface which is flush with one of the door side surfaces when the door is closed.

12. A housing, comprising:

a chamber body;

a door coupled to the chamber body and having a door thickness and a door controller housing opposing surface;

a chamber controller housing located on the chamber body and projecting outward from the chamber body a distance of a depth of the controller housing, and the controller housing having a controller housing door opposing surface;

wherein the door thickness substantially equals the depth of the controller housing; and wherein the controller housing is arranged on the chamber body such that when the door is in a closed position, the controller housing door opposing surface is parallel and proximate to the door controller housing opposing surface.

13. The housing according to the claim 12, wherein:

the door comprises a door top surface and a door side surface;

the controller housing comprises a top controller housing surface and a side top controller housing surface; and wherein the controller housing is arranged on the chamber body such that when the door is in a closed position, the door top surface is flush with the top controller housing surface and the door side surface is flush with the side top controller housing surface.

14. The housing according to the claim 13, wherein:

the controller housing comprises an outer controller housing surface;

the door comprises a door front surface; and wherein the controller housing is arranged on the chamber body such that when the door is in a closed position, the outer controller housing surface is flush with the door front surface.

* * * * *